United States Patent [19]

Tontarelli

[11] Patent Number: 5,068,987

[45] Date of Patent: Dec. 3, 1991

[54] PICTURE DISPLAY RECEPTACLE

[76] Inventor: Sergio Tontarelli, Via Gioletti 62, Fraz. S. Rocchetto, Castelfidardo, Ancona, Italy

[21] Appl. No.: 76,287

[22] Filed: Jul. 22, 1987

[30] Foreign Application Priority Data

Mar. 13, 1987 [IT] Italy ..... 520/87[U]

[51] Int. Cl.[5] ..... A47G 1/06; G09F 1/12

[52] U.S. Cl. ..... 40/152.1; 40/530; 40/389

[58] Field of Search ..... 40/152.1, 530, 395, 40/393, 390, 388, 401, 402, 518

[56] References Cited

U.S. PATENT DOCUMENTS

| | | | |
|---|---|---|---|
| 1,752,614 | 4/1930 | Ring | 40/518 |
| 2,177,405 | 10/1939 | Gross | 40/152.1 |
| 2,636,702 | 4/1953 | Brody | 40/152.1 |
| 2,646,143 | 7/1953 | Daleo et al. | 40/152.1 |
| 2,670,741 | 3/1954 | Nein | 40/389 |
| 2,926,441 | 3/1960 | Cross | 40/152.1 |
| 3,616,558 | 11/1971 | Jahn | 40/152.1 |
| 3,701,209 | 10/1972 | Kobusch | 40/152.1 |
| 4,222,190 | 9/1980 | Solomon | 40/530 |
| 4,290,216 | 9/1981 | Gale | 40/152.1 |
| 4,541,188 | 9/1985 | Sandorus | 40/152.1 |
| 4,622,767 | 11/1986 | Sullivan | 40/152.1 |
| 4,691,456 | 9/1987 | Ackeret | 40/489 |

*Primary Examiner*—James R. Brittain
*Assistant Examiner*—J. Hakomaki

[57] ABSTRACT

This invention concerns a box (receptacle) for holding and displaying photographs, in the form of a somewhat flattened parallelepiped, inside which one or more tidily stacked photographs of suitable format can fit exactly, and the first of which, starting from the top of the pile, is clearly visible from the outside of the box, in that the lid of the latter possesses a sizeable central window closed by a sheet of transparent material, thus obtaining the optical effect of making said photograph-holding box into a simple photograph frame, without giving any clues that would enable its primary function as a photograph holder to be seen or surmised. The box for holding photographs, according to the invention, is characterized by certain constructional aspects that render both its use and assembly particularly simple. According to one aspect of the invention the receptacle consists of a prop and a universal support, capable of sustaining the receptacle when positioned on an inclined plane, whichever side it happens to be resting upon; equally original is the provision of an elastic clip, incorporating the release button that, when pressed, causes the lid to automatically swing open.

18 Claims, 3 Drawing Sheets

PICTURE DISPLAY RECEPTACLE

FIELD OF INVENTION

This invention relates to a receptacle for holding photographs, in the form of a somewhat flattened parallelepiped, inside which one or more tidily stacked photographs of suitable format can fit and the first of which, starting from the top of the pile, is clearly visible from outside the receptacle, in that the lid of the latter possesses a sizeable central window closed by a sheet of transparent material, thus obtaining the optical effect of making said photograph-holding box into a simple photograph frame, without giving any clues that would enable its primary function as holder for photographs to be seen or surmised.

BACKGROUND OF INVENTION

Receptacles for photographs are known in the art. See for example U.S. Pat. Nos. 3,782,015; 4,443,959; 4,458,434; 4,413,435; 4,242,820; 4,571,865; 4,241,529 and 3,546,802. This invention relates to several original constructional aspects of a photograph receptacle that make its use particularly simple and efficient.

SUMMARY OF INVENTION

According to one aspect of the invention, a stabilizing and supporting prop (easel) is hinged onto the rear of the receptacle (box) for holding photographs, which is able to hold the box up, in an inclined position in relation to the plane upon which it is resting, whichever side said box happens to be standing upon.

In one aspect, the prop consists of a long, thin strip, hinged at one end with respect to a transverse plane and moveable in relation to the box from a supporting position in use to a collapse position for storage, the prop possessing a long, narrow central through slot which starts close to the end of the strip opposite the hinge and extends longitudinally beyond the mid-point of said strip.

On a transverse axis, inside said rectangular-shaped through slot, a small flat hinged lever is fitted, extending from the end of the slot towards the point at which the strip is fixed to the box where said strip is moveable from a position wherein the small flat hinged lever is parallel to the prop in storage to a position where the small flat hinged lever intersects the prop at a substantially acute angle in use.

When the stabilizing and supporting prop on the back of the receptacle for holding the photographs in question pivots laterally away from said holder until because of its elasticity, it flexes when it reaches its outer extent dislodging the small flat hinged lever to pivot towards the bottom of the holder out of the slot in which it is fitted to press against the rear of the box with its free end.

When the strip has been rotated to its full extent in one embodiment, it has to be bent slightly upwards so as to allow the end of the small lever that brushes the rear of the box to pass over a projection situated on the rear of the box, against which said small lever abuts and pushes as soon as the flexed strip is released. In other words, in this embodiment the small lever remains slightly compressed between the box and the strip, preventing the free rotation of the latter which remains firmly blocked in a fully opened position.

Whichever side the box is resting upon, the small lever, which acts as a support, prevents the strip from closing, so that the box always remains firmly sustained and in an inclined position.

According to another aspect of the invention, the receptacle for holding and displaying photographs, further comprises a button for opening the box which is closed on top by a rectangular lid, where said lid comprises a transparent material as the viewing portion, hinged along one of its shorter sides, said lid fitting inside the two longitudinal walls of the box.

The upward swinging lid when the box is being opened is automatic due according to one aspect of the invention, to the thrust of two springs that are compressed when the lid is lowered, each time the box for holding and displaying photographs is closed.

Near the shorter side of the lid opposite the hinge-end there is a central U-shaped through notch, inside which there is a small plate (extending parallel to the top of the receptacle or lid) which makes up one of the two horizontal wings of a C-shaped supporting spring clip, positioned on the inside of the lid from under the free edge of which a tab protrudes, at right angles to the plane of the lid.

On the external surface of said tab there is a raised button which, when the box for holding and displaying photographs is closed, through the elastic deformation of the aforesaid supporting clip (as the button engages the inner side wall of the end of the receptacle opposite the end to which the lid is hinged), clicks into a circular hole of the same shape and provided for this purpose, said hole being situated on the side wall of the box opposite the side to which the lid is hinged.

It is clear that to open the box for holding and displaying photographs it is sufficient to press said button from the outside, through the aforementioned hole, until it moves back far enough to come out of the seat in which it is housed and hooked, thus allowing the lid to automatically swing upwards due to the pressure of the aforesaid pre-compressed springs.

The particularly articulated shape of the C-shaped supporting spring clip, which incorporates the actual button for opening the box, for holding and displaying photographs, permits considerable elastic deformation with the minimum of effort; in other words, opening the box for holding and displaying photographs, according to the invention is both easy and quick to facilitate the removal or insertion of photographs, in that the pressure exerted from outside on the aforesaid button, in order to expel the latter from the seat in which it is housed and hooked, need be very little. Preferably the upper plate of the C-shaped supporting clip is hinged to the lid at the edge of the U-shaped through notch remote the end to which the lid is hinged. Preferably (for permitting flexing) the plate is concave (the center thereof being lower relative to the top of the lid than the edges).

BRIEF DESCRIPTION OF THE DRAWINGS

For further clarity of explanation the description continues with reference to the attached drawings of embodiments of the invention for illustrative and not restrictive purposes, in which.

DETAILED DESCRIPTION OF THE DRAWINGS

Figure 1:
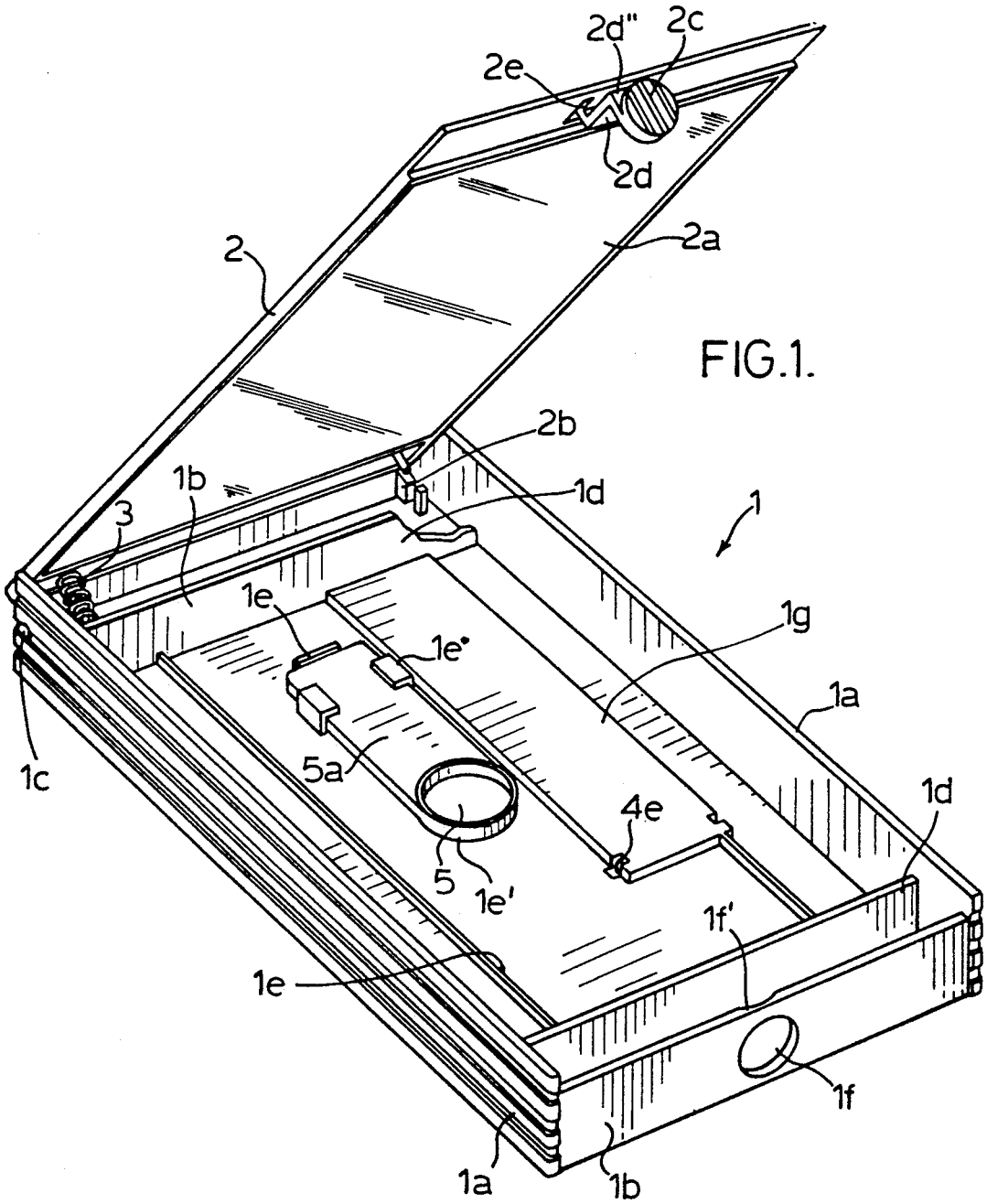
FIG. 1 is a perspective representation of the box (receptacle) for holding and displaying photographs according to an embodiment of the invention with the lid raised.

With reference to FIG. 1, the box (1), according to an embodiment of the invention is shaped like a somewhat flattened parallelepiped, with a rectangular plastic base, the longitudinal walls (1*a*) of which are slightly higher than the two transverse walls (1*b*), so that the plastic lid (2) in its entire thickness can nest therein, precisely within the two longitudinal walls (1*a*).

The lid (2) has a sizeable central plastic window, closed by a sheet (2*a*) of transparent material.

One of the two transversal sides (1*b*) of the box has two notches at the ends near the longitudinal walls (1*a*) within which two teeth (2*b*) are inserted; said teeth can rotate inside their respective notches and protrude from underneath the two corresponding edges of the lid (2); on the external surface of each of the said teeth (2*b*) there is a small pin which is inserted into a small hole (1*c*) provided for the purpose on the longitudinal sides (1*a*) inside which the lid (2) is thus pivoted.

Inside the box there are two transversal dividers (1*d*) near the walls (1*b*), the distance between these dividers being exactly equal to the length of the size of photograph for which this box is designed. The distance between the internal faces of the longitudinal walls (1*a*) is exactly equal to the width of the abovementioned photographs.

The lid (2) is raised automatically due to two precompressed cylindrical spiral springs (3), positioned near the teeth (2*b*) between the lid (2) and the bottom (1*e*) of the box (1), the ends of said springs (3) being inserted into support pins that project from the bottom (1*a*) and the lid (2) respectively.

The hooking of the lid (2) to the box (1) is effected by a button (2*c*) connected by means of an intermediate spring support clip (2*d*) to the lid (2); the lid (2), intermediate spring support clip (2*d*) and button (2*c*) being produced in a single moulding.

Figure 7:
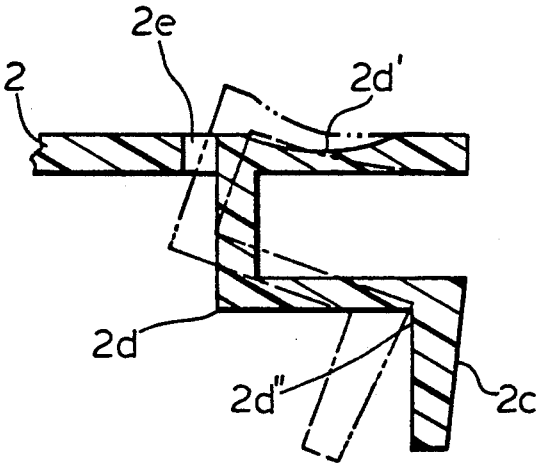
FIG. 7 shows the button for opening the box according to the invention, sectioned on a diametral longitudinal plane.

With reference to FIG. 7, the spring support clip (2*d*), sectioned along a longitudinal plane, is "C"-shaped, the upper wing (2*d'*) of which meets a section of the lid (2); this comes about as a result of a "U"-shaped notch (2*e*) situated on the lid, in such a way that a small plate (2*d'*) is isolated within the notch, said small plate (2*d'*) also forming the upper wing of the clip (2*d*).

To assist the flexibility of the clip (2*d*) the small plate (2*d'*) has a concave external surface, which actually reduces the thickness of the plate, thus providing it with greater elasticity.

From the front edge of the lower part of the clip (2*d*) there protrudes a tab (2*d''*), on a transversal plane, perpendicular to the lid (2); on said tab (2*d''*), and formed in the same moulding, there is an external button (2*c*) which is positioned precisely within a hole (1*f*) made for the purpose at the centre of the transverse wall (1*b*) of the box (1) at the end opposite to where the lid (2) is hinged; on the edge of the wall (1*b*) there is a hollow (1*f'*) which facilitates the entry of the button (2) into the hole (1*f*), following the progressive deformation of the clip (2*d*).

Figure 2:
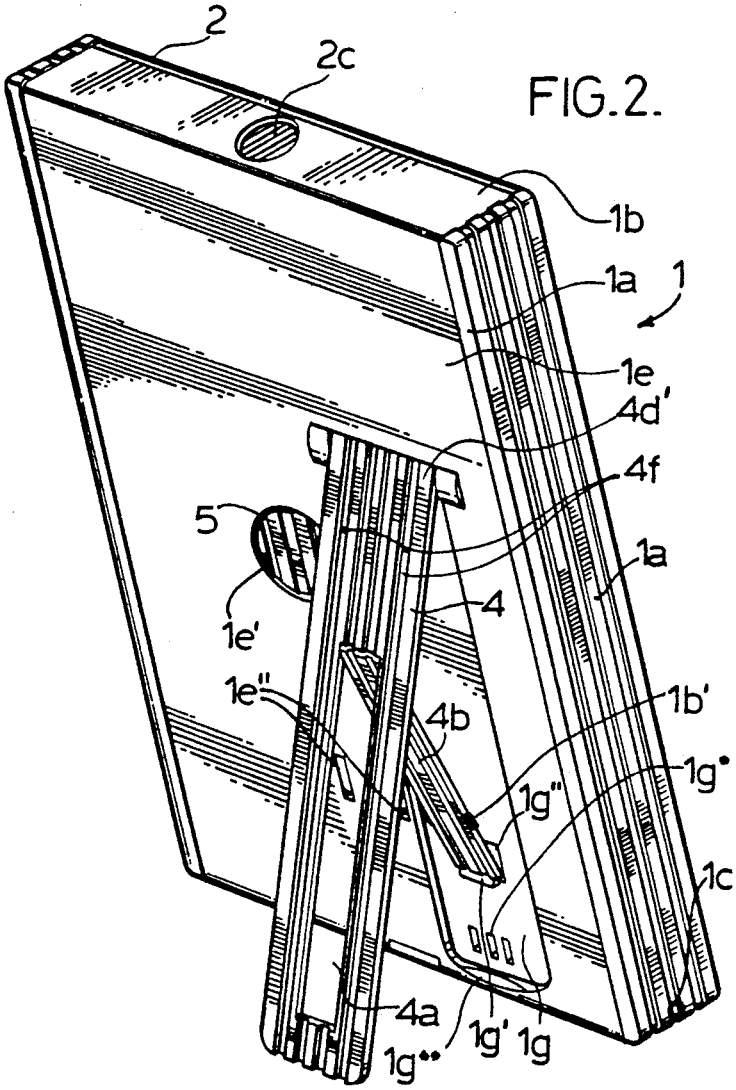
FIG. 2 is a perspective representation of the box for holding and displaying photographs according to the embodiment, seen from the back, with the stabilizing and supporting prop open.
Figure 3:
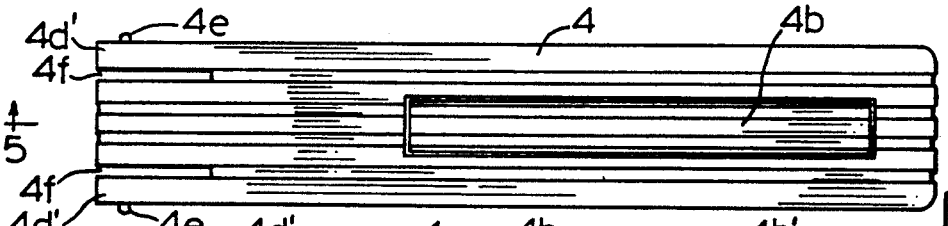
FIG. 3 is a plan view of the external surface of the strip, from which the stabilizing and supporting prop is created.
Figure 4:
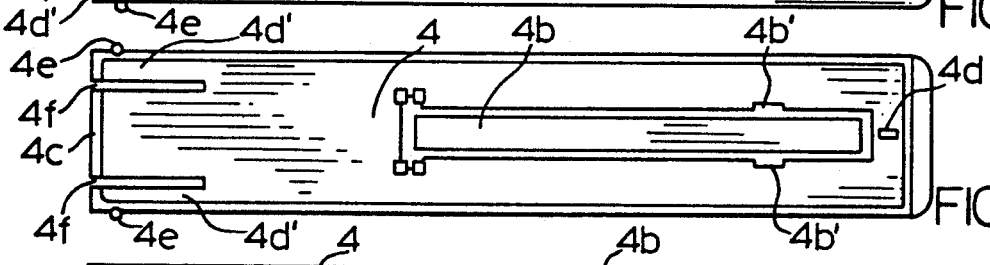
FIG. 4 is a plan view of the internal surface of the strip, from which the stabilizing and supporting prop is created.
Figure 5:
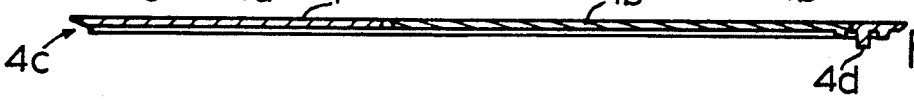
FIG. 5 is a section of FIG. 3 along the plan A—A.
Figure 6:
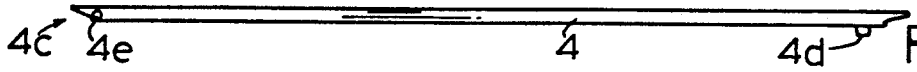
FIG. 6 is the orthographic projection of FIG. 3.
Figure 8:
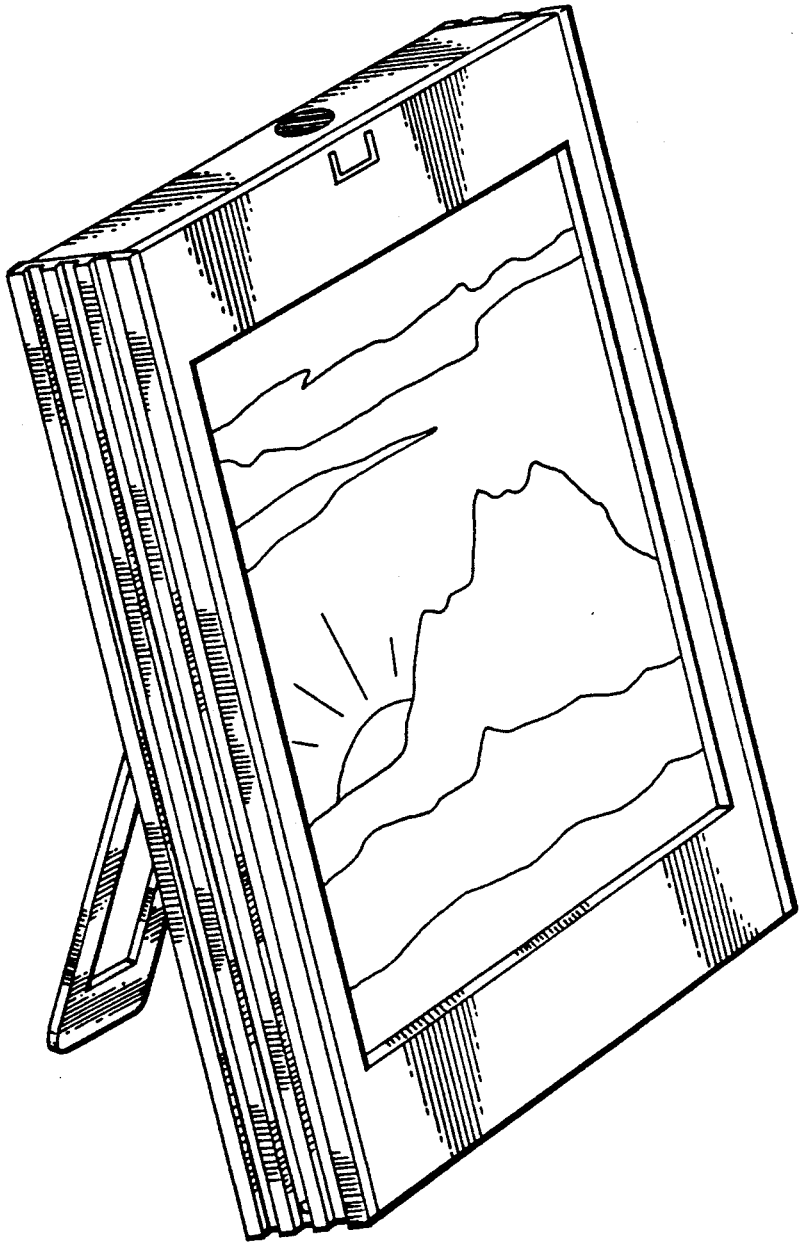
FIG. 8 is a perspective representation of a box for holding and displaying photographs according to the embodiment seen from the front with the stabilizing and supporting prop open.

With reference to FIG. 2 and FIG. 7, on the bottom wall (1*e*) of the box (1) there is a long external rectangular recess (1*g*), within which a strip (4) is precisely positioned and hinged, with respect to a transversal axis, said strip (4) being characterized by a longitudinal through slot (4*a*) within which a small lever (4*b*) is recessed and hinged on a transverse axis. This small lever (4*b*) can only emerge from its seat (4*a*) by rotating towards the bottom wall (1*e*) of the box (1) in that rotation in the opposite direction is prevented by two stops (4*b'*), emerging on opposite sides from the two longitudinal sides of the small lever (4*b*).

The hinged end of the strip (4) has an edge (4*c*) with a chamfered internal face, the inclination of which depends upon the maximum angle of flare of the strip (4); in fact, when the latter is fully opened, said chamfered edge abuts against the bottom of the recess (1*g*).

Once the strip (4) has reached its end of stroke position, it can be bent to enable the end of the small lever (4*b*), while continuing to brush across the bottom of the recess (1*g*), to pass over a transversal projection (1*g'*) beyond which there is a small, hollowed-out seat (1*g''*) where the end of the small lever (4*b*) positions itself and remains held, due to the pressure exerted by the elastic return movement of the strip (4), slightly deflected at the end of the stroke and then immediately released.

Number (1*g**) indicates a set of parallel longitudinal slots on the bottom of the recess (1*g*). Into the central slot a tooth (4*d*) of the same shape can be inserted, using slight pressure. This tooth protrudes from the internal wall of the strip (4) and can therefore be firmly positioned within the recess (1*g*) until it needs to be extracted therefrom, a dip (1*g***) being provided for this purpose on the edge of the recess (1*g*) where a nail can easily be inserted in order to extract the strip (4). The set of slots (1*g**) is aimed to allow a certain elastic flexing of the two longitudinal sides of the central slot into which the tooth (4*d*) must be inserted by exerting slight pressure.

Attention should be paid to the extremely simple and economic form of construction adopted for the hinging of the strip (4) within the recess (1*g*), which is effected by two coaxial pins (4*e*) emerging opposite one another from the longitudinal sides of the strip (4) and positioned inside two corresponding holes provided for the purpose on the longitudinal walls of the recess (1*g*).

In order to easily and rapidly insert these anchoring pins (4*e*) into the abovementioned holes there are two off-centre longitudinal notches (4*f*) on the end of the strip (4) which allow the two external sections (4*d*), automatically formed on the end of the strip (4), consequent to the formation of the two off-centre notches (4*f*), to bend elastically inwards.

In FIGS. 1 and 2, number (5) indicates a button positioned at the end of a longitudinal plate (5*a*), the other end of which is fixed to the inside of the bottom wall (1*e*) of the box. On the bottom wall of the box there is a hole (1*e'*) through which, by pressing the abovementioned button (5) from the outside of the box (1) towards the inside, the plate (5*a*) is caused to bend, thus enabling the easy and quick ejection of the stack of photographs from the box inside which they fit exactly.

To rapidly and simply fix the plate (5*a*) to the bottom wall (1*e*) of the box (1) two wedge-shaped teeth are positioned below the plate (5*a*) which are inserted and fixed within two corresponding longitudinal slots (1*e'*) provided for the purpose on the bottom (1*e*), both below the horizontal wing of a longitudinal projection (1*e) with an overturned "L"-shaped section; during assembly, the end of the plate (5***a*) is pressed between and slid underneath the pair of abovementioned projections (1*e) until it reaches a ledge provided by a tooth (1*e*) which lies transversely between the two abovementioned projections (1*e**).

Figure 9:
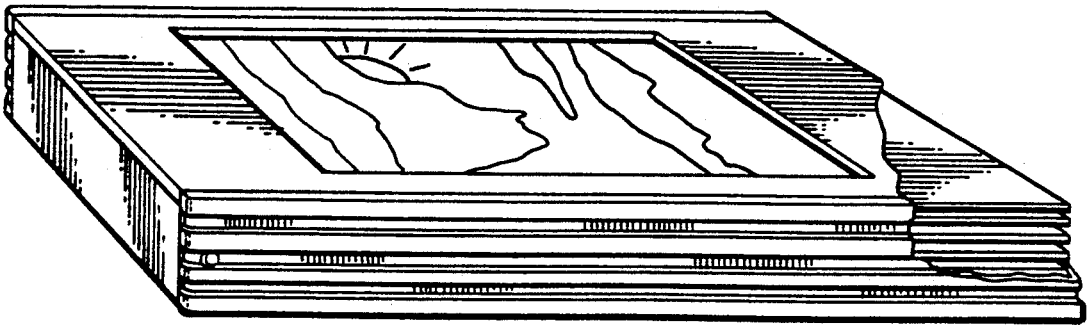
FIG. 9 is a perspective representation of a box for holding and displaying photographs according to the embodiment seen in the storage position displaying the stack of photographs.

With reference to FIG. 9, the receptacle for holding and displaying photographs along with the positioning of the stack of photographs is shown.

As many changes can be made to the embodiments of the invention without departing from the scope of the invention, it is intended that all matter contained herein be interpreted as illustrative thereof and not in a limiting sense.

The embodiments of the invention in which an exclusive property or privilege is claimed are as follows:

1. A receptacle for holding and displaying a stack of photographs and for presenting the top photograph for view comprising a front and rear and two sides, the receptacle being hinged at one end, the front being moveable in relation to the rear from a first position wherein the front is locked proximate the rear by locking means to a second position wherein the front is unlocked remote the rear yet hingedly supported at its hinged end to the rear, the receptacle thereby being totally enclosed, the front thereof having a transparent central portion circumscribed by a border, the rear thereof having detent means and a recess and carrying a stabilizing and supporting prop hinged onto the rear of the receptacle, wherein the prop consists of a long, thin strip, hinged at one end with respect to a transverse plane and moveable in relation to the receptacle from a supporting portion in use to a collapsed position wherein the prop is contained in the recess for storage, the prop possesses a long, narrow central through slot which starts close to the end of the strip opposite the hinge and extends longitudinally beyond the mid-point of said strip, wherein on the transverse axis, inside said rectangular-shaped through slot, a small flat hinged lever having detent means at the end remote the hinge, the lever being fitted and extending from the end of the slot towards the point at which the strip is fixed to the receptacle, and moveable from a position wherein the small flat hinged lever is parallel to the prop in storage to a position wherein the small flat hinged lever intersects the prop at an angle whereat the detent means of the lever engages the detent means on the rear of the receptacle thereby maintaining the receptacle in a propped position.

2. A receptacle for holding and displaying stack of photographs and for presenting the top photograph for view comprising a front and rear and two sides, the receptacle being hinged at one end, the front being moveable in relation to the rear from a first position wherein the front is locked proximate the rear by locking means to a second position wherein the front is unlocked remote the rear yet hingedly supported at its hinged end to the rear, the receptacle thereby being totally enclosed, the front thereof having a transparent central portion circumscribed by a border, the rear thereof having detent means and a recess and carrying a stabilizing and supporting prop hinged onto the rear of the receptacle, wherein the prop consists of a long, thin strip, hinged at one end with respect to a transverse plane and moveable in relation to the receptacle from a supporting position in use to a collapsed position wherein the prop is contained in the recess for storage, the prop possesses a long, narrow central through slot which starts close to the end of the strip opposite the hinge and extends longitudinally beyond the mid-point of said strip, wherein on the transverse axis, inside said rectangular-shaped through slot, a small flat hinged lever having detent means at the end remote the hinge, the lever being fitted and extending from the end of the slot towards the point at which the strip is fixed to the receptacle, and moveable from a position wherein the small flat hinged lever is parallel to the prop in storage to a position wherein the small flat hinged lever intersects the prop at an angle whereat the detent means of the lever engages the detent means on the rear of the receptacle thereby maintaining the receptacle in a propped position, wherein the detent means on the front further comprises a centrally U-shaped through notch, inside which there is a small plate (extending parallel to the front of the receptacle) which makes up one of two horizontal wings of a C-shaped supporting spring clip, positioned on the inside of the front from under the free edge of which a tab protrudes, at right angles to the plane of the front, a raised button being provided on external surface of said tab, the button when the receptacle is closed, through the elastic deformation of the aforesaid supporting clip (as the button engages the inner side wall of the end of the receptacle opposite the end to which the front is hinged), clicks into a circular hole of the same shape, said hole being situated on the side wall of the box opposite the side to which the front is hinged.

3. The receptacle of claim 1 or 2 wherein when the stabilizing and supporting prop on the rear of the receptacle pivots laterally away from said receptacle until because of its elasticity, it flexes when it reach its outer extent dislodging the small flat hinged lever to pivot towards the rear of the receptacle out of the slot in which it is fitted, to engage with the rear of the receptacle with its free end.

4. The receptacle of claim 3 wherein a projection is situated on the rear of the receptacle, against which said small flat hinged lever abuts and pushes as soon as the flexed strip is released.

5. The receptacle of claim 4 wherein the small flat hinged lever remains slightly compressed between the box and the strip, when in the display position.

6. A receptacle for holding photographs, the receptacle having a top closed by a rectangular lid hinged at one side, the receptacle comprising a button for opening the box which is closed on top by the rectangular lid, the lid comprising opposite the end that is hinged, a central U-shaped through notch, inside which there is a small plate (extending parallel to the top of the receptacle or lid) which makes up one of two horizontal wings of a C-shaped supporting spring clip, positioned on the inside of the lid form under the free edge of which a tab protrudes, at right angles to the plane of the lid, a raised button being provided on external surface of said tab, the button when the box is closed, through the elastic deformation of the aforesaid supporting clip (as the button engages the inner side wall of the end of the receptacle opposite the end to which the lid is hinged), clicks into a circular hole of the same shape, said hole being situated on the side wall of the box opposite the side to which the lid is hinged.

7. The receptacle of claim 6 wherein the upper plate of the C-shaped supporting clip is hinged to the lid at the edge of the U-shaped through notch remote the end to which the lid is hinged.

8. The receptacle of claim 7 wherein the plate is concave (the center thereof being lower relative to the top of the lid than the edges) for permitting flexing of the plane.

9. The receptacle of claims 6, 7 or 8 wherein the button is tapered.

10. A box for holding photographs with a hinged lid which can be opened automatically by means of an easily activated release button, equipped with a universal stabilizing and supporting prop and comprising a somewhat flattened rectangular box closed at the top by a lid with a sizeable central window closed by a transparent sheet and hinged, with respect to a transverse axis, to the inside of the two longitudinal walls of the box, characterized by the fact that the lid is hooked and held against the transverse wall of the box by means of a tapered release button connected by an intermediate spring support clip to the lid, the lid support clip and button being integral and preferably of one single moulding and the spring support clip being "C"-shaped when sectioned on a longitudinal plane, the upper wing thereof meeting a section of the lid, said section having been isolated by a "U" shaped notch made in said lid; from the front edge of the lower part of the clip a tab protrudes downwards, situated on the same plane as the lid; integral with said tab and formed in the same moulding there is a tapered button which is housed precisely within a hole located at the centre of the transverse wall of the box, opposite the wall where the lid is hinged.

11. The receptacle of claim 1 or 2 further comprising a universal stabilizing and supporting prop which is able to sustain the inclined receptacle, whichever side it happens to be resting upon, by means of a strip, hinged at one end to the rear of the receptacle, and a central longitudinal slot within which a small lever is slotted and hinged, said lever only being able to emerge from its seat by rotating towards the rear of the receptacle, on the rear of which there is a cavity inside which the free end of the small lever fits and remains locked after having passed over a projection on the edge of the cavity.

12. The receptacle of claim 1 or 2, wherein the prop is housed precisely within a recess of the same shape on the rear of the receptacle.

13. The receptacle of claim 1 or 2, wherein the hinged front can be opened automatically by means of an easily activated release button, equipped with a universal stabilizing and supporting prop, whereat the hinged end of the prop there are two off-centre longitudinal symmetrical notches which allow the two outer sections, formed at the end of the prop as a consequence of said notches, to bend in an elastic fashion; having on the external sides of each section a fixing pin which is housed precisely within a slot on both of the longitudinal walls of the recess.

14. The receptacle claim 1 or 2, wherein the front is hinged to the receptacle by means of two teeth jutting internally from the corners of the front, housed in two notches at the two ends of the transversal side of the receptacle within which they can rotate; on the outside of said teeth there are two pins, each of which is housed within a small hole on the longitudinal sides of the receptacle.

15. The receptacle of claim 1, 2 or 6, wherein on the rear of the receptacle there is a hole through which a button can be pushed inwards towards the front, said button being formed at the end of an elastic plate fixed at its other end to the rear of the receptacle, the button when depressed to urge the photographs towards the front of the receptacle for removal therefor.

16. The receptacle of claim 5 wherein underneath the end of the elastic plate remote the button there are two wedge-shaped teeth which are inserted and remain blocked within two corresponding longitudinal slots on the rear of the receptacle, each slot being below the horizontal wing of two respective projections, said projections having a section in the form of an overturned "L" and between which the end of the plate is pressed and slid until it touches a ledge provided by a tooth on the rear positioned transversely between the two projections.

17. The receptacle of claim 2 or 6, wherein the upper wing of the spring support clip of the button has a concave external surface, and sectioned on a longitudinal plane, a semi-circular, arched profile.

18. The receptacle of claim 10, wherein on the rear of the receptacle there is a hole through which a button can be pushed inwards towards the front, said button being formed at the end of an elastic plate fixed at its other end to the rear of the receptacle, the button when depressed to urge the photographs towards the front of the receptacle for removal therefor.

* * * * *